US008135330B2

(12) United States Patent
Horade

(10) Patent No.: US 8,135,330 B2
(45) Date of Patent: Mar. 13, 2012

(54) IMAGE RECORDING DEVICE AND DETERMINATION METHOD

(75) Inventor: Kenta Horade, Kiyosu (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 890 days.

(21) Appl. No.: 12/165,113

(22) Filed: Jun. 30, 2008

(65) Prior Publication Data

US 2009/0003908 A1 Jan. 1, 2009

(30) Foreign Application Priority Data

Jun. 28, 2007 (JP) ..... 2007-170085

(51) Int. Cl.
*G03G 15/00* (2006.01)

(52) U.S. Cl. ..... 399/395; 399/388

(58) Field of Classification Search ..... 399/395, 399/388

See application file for complete search history.

(56) References Cited

U.S. PATENT DOCUMENTS

| | | | | |
|---|---|---|---|---|
| 6,102,595 | A | 8/2000 | Satoh et al. | |
| 6,511,063 | B1 * | 1/2003 | Dickhoff et al. | 271/184 |
| 6,895,210 | B1 * | 5/2005 | Quesnel | 399/395 |
| 7,088,948 | B2 * | 8/2006 | Puckett et al. | 399/395 |
| 7,467,793 | B2 * | 12/2008 | Tanabe | 271/245 |
| 2001/0005464 | A1 * | 6/2001 | Funada | 400/578 |
| 2007/0040326 | A1 * | 2/2007 | Noda et al. | 271/227 |

FOREIGN PATENT DOCUMENTS

| | | | |
|---|---|---|---|
| JP | 01218865 A | * | 9/1989 |
| JP | H04-84245 U | | 7/1992 |
| JP | 2001092327 A | * | 4/2001 |
| JP | 2001097607 A | | 4/2001 |
| JP | 2004090316 A | | 3/2004 |

* cited by examiner

*Primary Examiner* — Daniel J Colilla
*Assistant Examiner* — Allister Primo
(74) *Attorney, Agent, or Firm* — Baker Botts L.L.P.

(57) ABSTRACT

A image recording device includes a sheet feeding unit, an image recording unit, a first feeding control unit, a determination unit, and a recording control unit. The sheet feeding unit feeds a sheet member along a sheet feeding path in a sheet feeding direction. The image recording unit records an image on the sheet member and defines a recordable area which is an area for forming the image on the sheet member. The first feeding control unit controls the sheet feeding unit to feed the sheet member to an entry position before the image recording unit starts to record the image on the sheet member. The determination unit determines whether the sheet member located at the entry position has a skew. The recording control unit controls the image recording unit to record the image on the sheet member based on a determination result of the determination unit.

12 Claims, 12 Drawing Sheets

FIG.12

36

| SHEET TYPE (LENGTH OF SHEET) | THRESHOLD VALUE |
|---|---|
| L SIZE (127) | 2.00 |
| A6 SIZE (148.5) | 1.71 |
| 2L SIZE (178) | 1.43 |
| POSTCAED SIZE (200) | 1.27 |
| A5 SIZE (210) | 1.21 |
| A4 SIZE (297) | 0.86 |
| LEGAL SIZE (355.6) | 0.71 |

UNIT (mm)

IMAGE RECORDING DEVICE AND DETERMINATION METHOD

CROSS REFERENCE TO RELATED APPLICATION

The present application claims priority from Japanese patent application No. 2007-170085 filed Jun. 28, 2007. The entire content of the priority application is incorporated herein by reference.

TECHNICAL FIELD

The present invention relates to an image recording device for recording an image on a sheet member, and more particularly to an image recording device capable or determining whether or not a sheet member deviates from a predetermined sheet feeding path, and a determination method thereof.

BACKGROUND

An ink-jet recording device includes an ink-jet recording head and a carriage. The carriage reciprocates in a direction substantially orthogonal (hereinafter, referred to as an "orthogonal direction") to a feeding direction of a recording sheet (sheet member). An ink-jet recording head is mounted on the carriage. In the ink-jet recording device, while the recording sheet is being fed below the ink-jet recording head along a predetermined sheet feeding path, the ink-jet recording head selectively ejects droplets of ink, as the carriage reciprocates in the orthogonal direction. The ink droplets adhere onto the recording sheet, thereby recording an intended image on the recording sheet.

In the ink-jet recording device, a recording sheet sometimes has a paper skew with respect to the sheet feeding direction when the recording sheet is fed along the sheet feeding path. If an image is recorded in a state that the recording sheet is slanted, the recorded image is slanted with respect to the four edges of the recording sheet.

The paper skew of a recording sheet can be detected, for example, by a method described in Japanese Utility Model Application Publication No. H04-84245. Japanese Utility Model Application Publication No. H04-84245 discloses that a skew amount of the recording sheet is detected based on the positions of the side edges of the recording sheet in the orthogonal direction before the recording sheet is fed to and below a printing unit. Specifically, the carriage includes two reflection sensors provided at a distance away, from each other in the feeding direction. While the carriage reciprocates in the orthogonal direction, the reflection sensors detect the positions of both side edges of the recording sheet in the orthogonal direction before the recording sheet is fed to and below a printing unit. The skew amount of the recording sheet is obtained based on the detected result. Another method is also described in Japanese Utility Model Application Publication No. H04-84245. The carriage includes one reflection sensor. While the carriage reciprocates in the orthogonal direction at a specific portion of a recording sheet, the reflection sensor detects the positions of both side edges of the recording sheet before the recording sheet is fed to and below a printing unit. The recording sheet is then fed a prescribed distance from the specific portion in the feeding direction, so that the reflection sensor detects the both side edge positions of the recording sheet again in the same manner at another portion of the recording sheet. The skew amount of the recording sheet is obtained based on these detected results.

In the ink-jet recording device described in Japanese Patent Application Publication No. 2004-90316, a reflection-type photointerrupter is mounted on a carriage. As the carriage reciprocates for the first cycle, the photointerrupter detects the positions of both side edges of the recording sheet in the orthogonal direction. As the carriage reciprocates for the second cycle or later, the reflection-type photointerrupter detects the position of one side edge. The other side edge position of the recording sheet in the orthogonal direction is calculated accurately based on the detected result.

SUMMARY

In the method described in Japanese Utility Model Application Publication No. H04-84245, the edge positions of the recording sheet and the skew, amount thereof are detected before the recording sheet reaches the printing unit. Thus, this method cannot detect a paper skew which occurs in an area where, image recording is available (recordable area), even if no paper skew has not been occurred before the recording sheet reaches the recordable area. In this case, image recording is performed in a state that the recording sheet has the paper skew. On the other hand, the ink-let recording device described in Japanese Patent Application Publication No. 2004-0.90316, detects the edge positions of a recording sheet, and records an image thereon at the same time. The inkjet recording device keeps image-recording on the recording sheet until the ink-jet recording device detects the edge positions of the recording sheet at least for the second cycle of the carriage. Therefore, in the case where the recording sheet already has the paper skew by the time when the one edge position is detected for the second cycle of the carriage, the recorded image becomes slanted relative to the four edges of the recording sheet.

In neither of the methods, a user can obtain the user's desired recorded image. In both cases, the user has to try image recording again. This means that an extra recording sheet and extra recording materials such as ink or toner are consumed wastefully. This is an extremely important concern, because expensive recording sheets such as glossy paper have been heavily used recently with the resolution improvement of image recording devices and the development of photographic printing technology.

In view of the foregoing, it is an object of the present invention to provide an image recording device capable of accurately detecting a paper skew of a recording sheet, thereby avoiding wasteful consumption of recording sheets and recording materials such as ink or toner.

To achieve the above and other objects, one aspect of the invention provides an image recording device including a sheet feeding unit, an image recording unit, a first feeding control unit, a determination unit, and a recording control unit. The sheet feeding unit feeds a sheet member along a sheet feeding path in a sheet feeding direction. The image recording unit records an image on the sheet member and defines a recordable area which is an area for forming the image on the sheet member. The first feeding control unit controls the sheet feeding unit to feed the sheet member to, an entry position before the image recording unit starts to record the image on the sheet member. The determination unit determines whether the sheet member located at the entry position has a skew. The recording control unit controls the image recording unit to record the image on the sheet member based on a determination result of the determination unit.

In another aspect of the present invention, there is provided a determination method for a multifunction peripheral. The multifunction peripheral includes a sheet feeding unit that feeds a sheet member along a sheet feeding path in a sheet feeding direction, and an image recording unit that records an image on the sheet member and defines a recordable area which is an area for forming the image on the sheet member. The determination method includes:

controlling the sheet feeding unit to feed the sheet member to an entry position before the image recording unit starts to record the image on the sheet member;

determining whether the sheet member located at the entry position has a skew before the image recording unit starts to record the image on the sheet member; and controlling the image recording unit to record the image on the sheet member based on a determination result of the determining step.

In another aspect of the present invention, there is provided a determination method for a multifunction peripheral. The multifunction peripheral includes a sheet feeding unit, a carriage, a recording head, and a photosensor. The sheet feeding unit feeds a sheet member along a sheet feeding path in a sheet feeding direction. The carriage reciprocates in a widthwise direction perpendicular to the sheet feeding direction. The recording head is supported by the carriage, ejects ink droplets to the recording sheet for forming the image, and defines a recordable area which is an area for forming the image on the sheet member. The photosensor is supported by the carriage. The sheet member has a first position and a second position which are away from each other in the sheet feeding direction. The determination method includes:

controlling the sheet feeding unit to feed the sheet member to an entry position before the recording head starts to record the image on the sheet member;

detecting a first one side edge position of the first position of the sheet member and a second one side edge position of the second position of the sheet member in the widthwise direction by the photosensor;

calculating a displacement amount based on the first one side edge position and the second one side edge position; and determining whether the recording head starts to record the image on the recording sheet based on the displacement amount.

BRIEF DESCRIPTION OF THE DRAWINGS

In the drawings;

FIG. 12 is a table showing threshold values according to the embodiment.

DETAILED DESCRIPTION

Hereinafter, an image recording device according to an embodiment of the present invention is described with reference to the accompanying drawings. The image recording device of the embodiment is applied to a multifunction peripheral 10. The following embodiment is only an example of the invention, and may be changed within the scope of the present invention. A reciprocating tool according to a first embodiment of the present invention will be described while referring to FIGS. 1 through 7.

Figure 1:
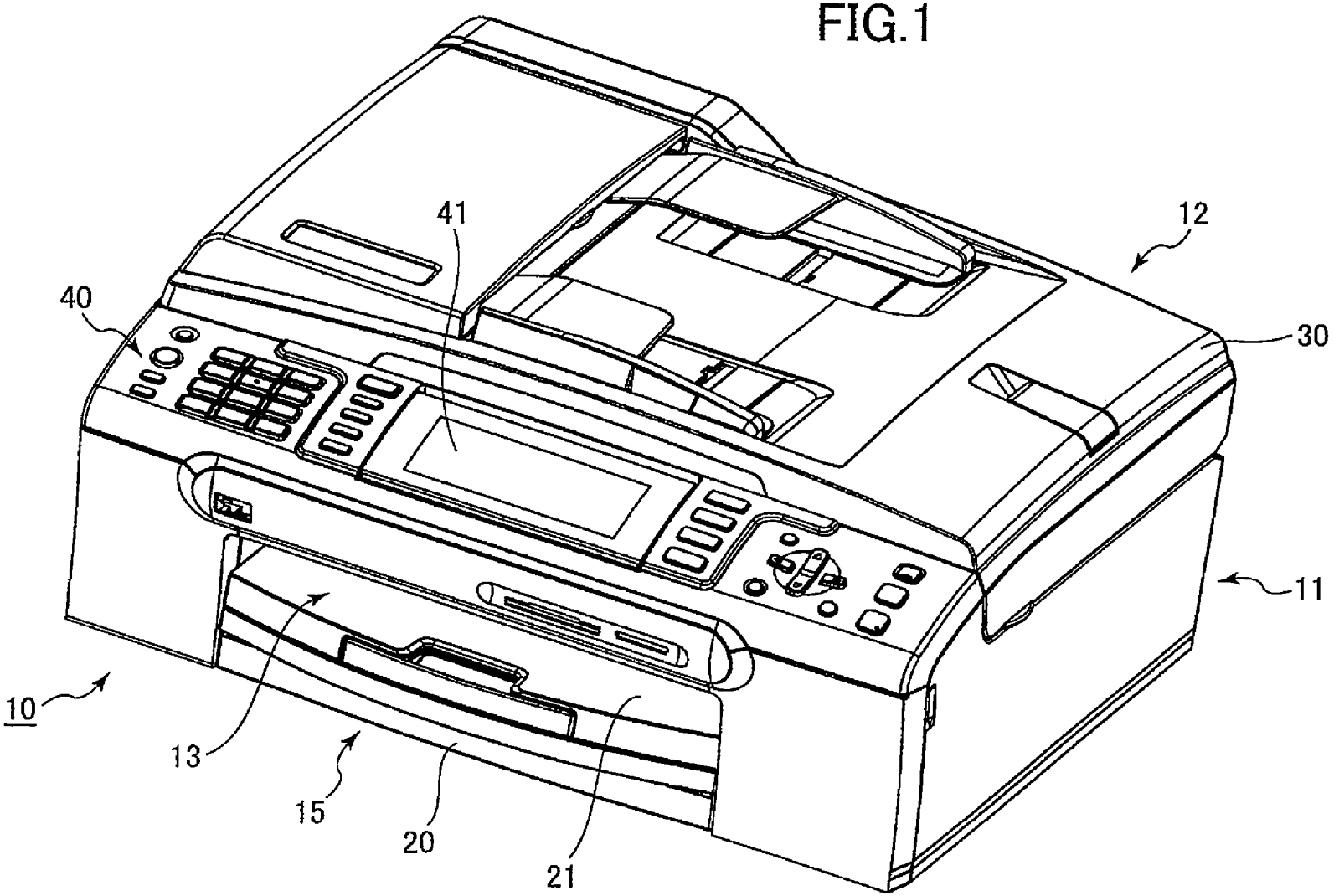
FIG. 1 is a perspective view showing an appearance of a multifunction peripheral according to an embodiment of the present invention.

Referring to FIG. 1, a structure of the multifunction peripheral 10 and an operation thereof are outlined as an exemplary image recording device according to the present invention. FIG. 1 is a perspective view showing an external structure of the multifunction peripheral 10.

Figure 5:
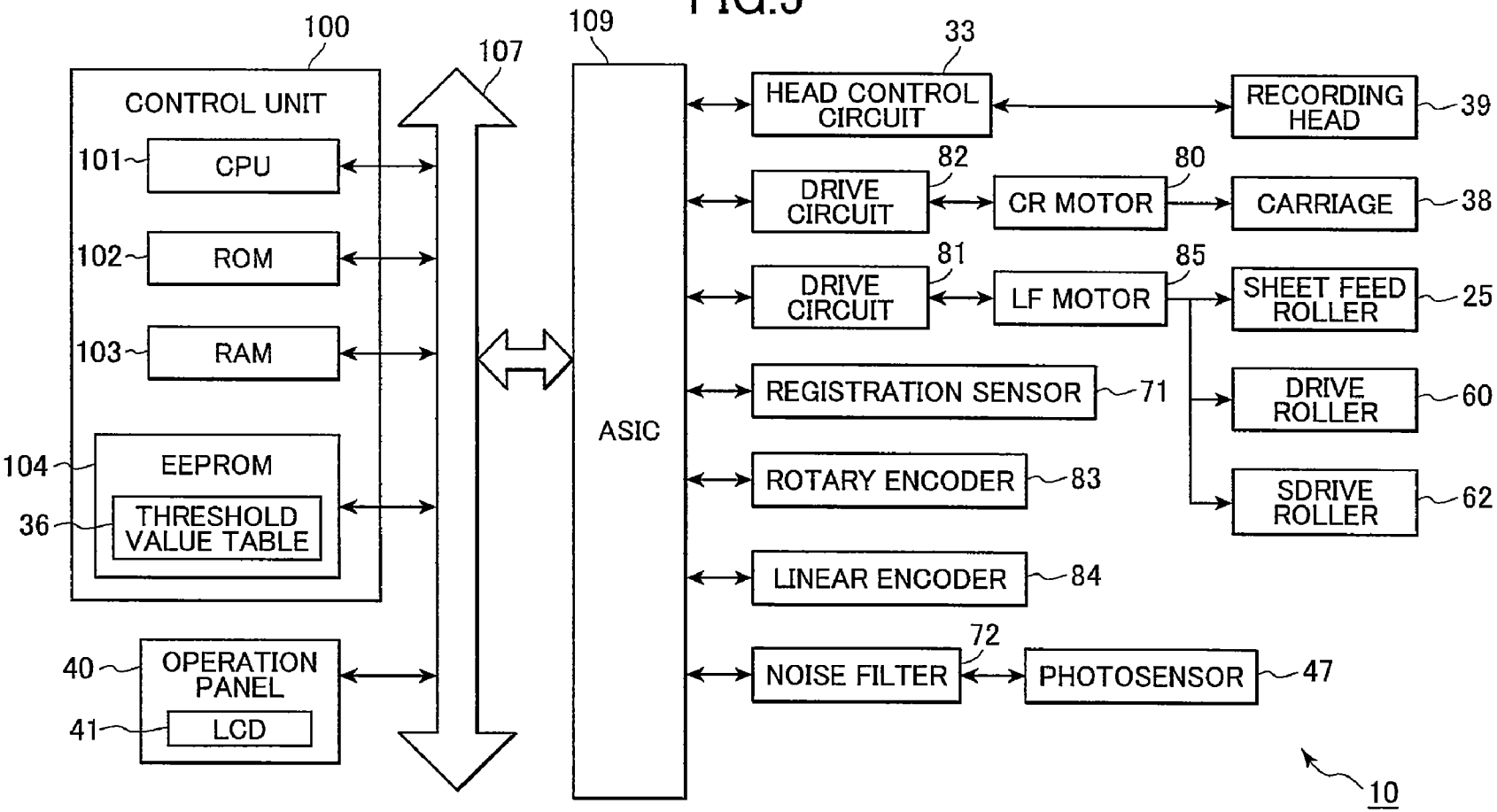
FIG. 5 is a block diagram briefly showing a structure of a control unit according to the embodiment.

As shown in FIG. 1, the multifunction peripheral 10 is a multifunction device (MFD) including a printing unit 11 and a scanner unit 12. The multifunction peripheral 10 has a printing function, a scanning function, a copying function, and a facsimile function. These functions are implemented by controlling the printing unit 11 and the scanner unit 12 via a control unit 100 to be described later (see. FIG. 5) included in the multifunction peripheral 10. The present invention is applicable not only to the multifunction peripheral 10 having the plural functions, but also to an image recording device having at least the printing function.

The multifunction peripheral 10 is formed into a substantially rectangular solid which is thin and broad-shouldered. The multifunction peripheral 10 has a width and a depth longer than a height. The scanner unit 12 is provided in an upper portion of the multifunction peripheral 10. The scanner unit 12 includes a flat bed scanner (FBS) and an automatic document feeder (ADF). As shown in FIG. 1, the multifunction peripheral 10 includes a document cover 30 rotatably attached to the FBS via hinges, as a top board. The ADF is provided on the document cover 30. Although not shown, a platen glass plate and an image sensor are provided below the document cover 30. Both an image of a document placed on the platen glass plate, and an image of a document fed by the ADF are captured by the image sensor. Since the scanner unit 12 may have an arbitrary structure to implement the present invention, a detailed description thereof is omitted here.

The printing unit 11 is provided in a lower portion of the multifunction peripheral 10. The printing unit 11 records an image, text, or the combination of both on a recording sheet (sheet member) 50 (see FIG. 2), based on image data captured by the scanner unit 12, or based on print data inputted from an external device network-connected to the multifunction peripheral 10. An opening 13 is formed at the front of the printing unit 11. The opening 13 allows the user to take out the recording sheet 50 therethrough when the recording sheet 50 is discharged on the opening 13 after image recording. A sheet cassette 15 for accommodating recording sheets 50 is provided inside the opening 13. The sheet cassette 15 includes a paper feed tray 20 and a paper discharge tray 21. The paper feed tray 20 and paper discharge tray 21 are arranged in two levels vertically, with the paper discharge tray 21 disposed above the paper feed tray 20. The sheet cassette 15 is formed integrally with the paper discharge tray 21 as a lid to be put on the paper feed tray 20. The sheet cassette 15 is insertable into the printing unit 11 through the opening 13.

The paper feed tray 20 accommodates a stack of recording sheets 50 to be used for image recording. Examples of types of recording sheets 50 include plain paper, glossy paper, ink-jet printing paper, and postcard paper. Examples of sizes of recording sheets 50 include L size, A6 size, 2L size, postcard size, A5 size, A4 size, and legal size. While each recording sheet 50 is being fed along the sheet feeding path 23 (see FIG. 2) from the paper feed tray 20, an image is recorded on the recording sheet 50. The recording sheet 50 is then discharged into the inside of the printing unit 11. The recording sheet 50 thus discharged is placed on the paper discharge tray 21.

An operation panel 40 is provided in an upper front portion of the multifunction peripheral 10. The operation panel 40 includes a liquid crystal display (LCD) 41 for displaying various types of information thereon; and various keys for allowing the user to input information. The LCD 41 displays a setting status of the multifunction peripheral 10, error information, status information such as operational status, and the like. The multifunction peripheral 10 operates based on predetermined command signals inputted from the operation panel 40 and based on command signals inputted from the network-connected external device.

Figure 2:
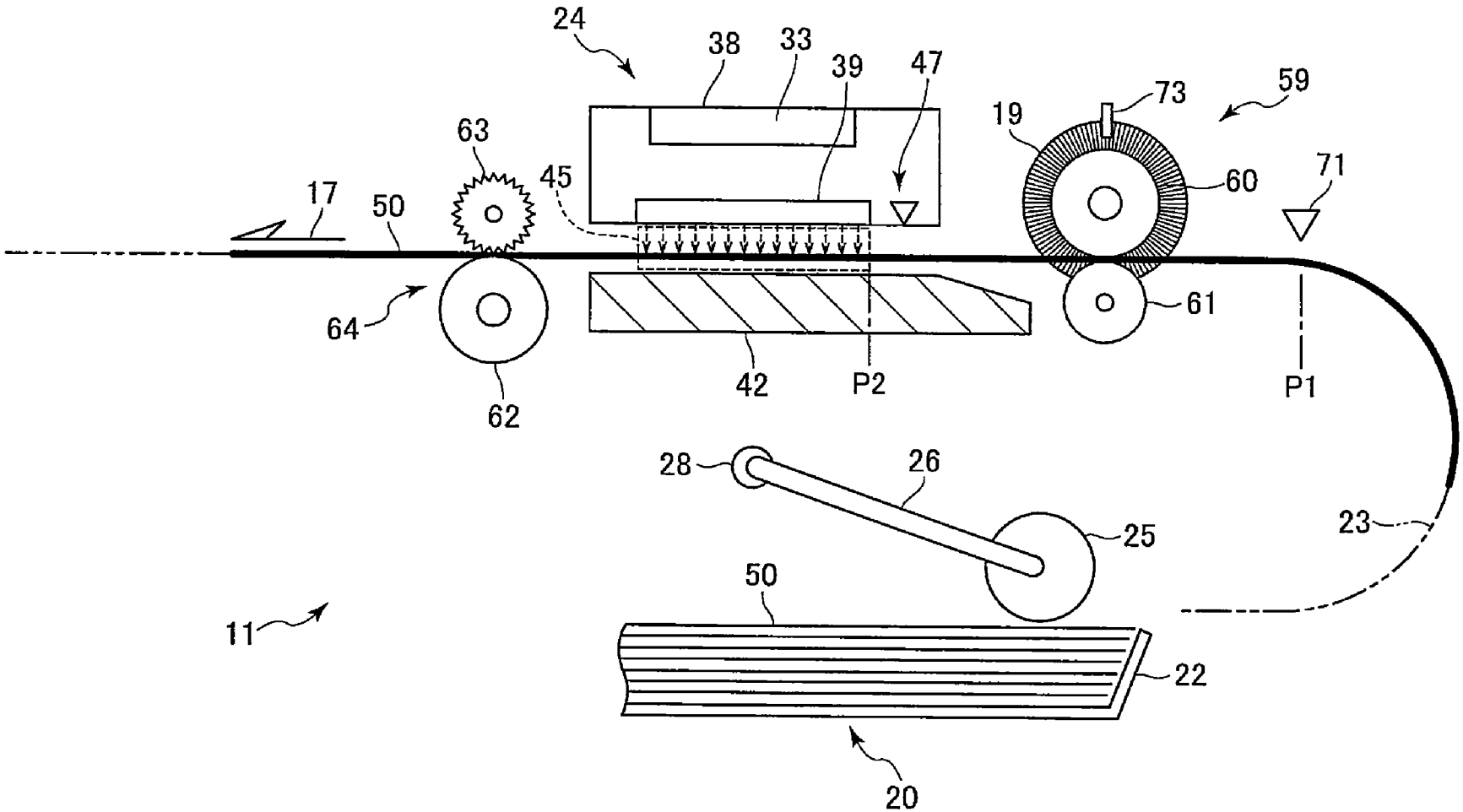
FIG. 2 is schematic diagram showing an inner structure of a printing unit of the multifunction peripheral according to the embodiment.

Next, the inner structure of the multifunction peripheral 10, and particularly for a structure of the printing unit 11 will be described with reference to FIG. 2. FIG. 2 is a schematic diagram showing the inner structure of the printing unit 11. In FIG. 2, a portion of the paper feed tray 20 and the paper discharge tray 21 are omitted.

The paper feed tray 20 is located on a bottom portion of the printing unit 11 (see FIG. 1 and FIG. 2). Each recording sheet 50 accommodated by the paper feed tray 20 is fed to the inside of the printing unit 11. As shown in FIG. 2, an inclined plate 22 is provided in a rear portion of the paper feed tray 20 (right side in FIG. 2). The inclined plate 22 is inclined toward a backside of the multifunction peripheral 10 (right side in FIG. 2). The inclined plate 22 is for separating each recording sheet 50 from the stack of sheets accommodated by the paper feed tray 20 and for guiding the separated recording sheet 50 to be fed upward. A sheet feeding path 23 is positioned above the separation guide plate 22. The sheet feeding path 23 is a path along which, each recording sheet 50 is fed. The feeding path 23 has a bent portion. Specifically, the sheet feeding path 23 extends upward from the inclined plate 22, and then curves toward the front side of the multifunction peripheral 10 (left side in FIG. 2). The sheet feeding path 23 further passes through a recording unit 24, and finally leads to the paper discharge tray 21 (see FIG. 1).

As shown in FIG. 2, the sheet feed roller 25 is provided above the paper feed tray 20. The sheet feed roller 25 contacts the recording sheet 50 on the top of the stack accommodated by the paper feed tray 20 with pressure and feeds each recording sheet 50 to the sheet feeding path 23. A shaft 28 is supported by a frame (not shown) in the printing unit 11. An arm 26 is swingably connected to the shaft 28. The sheet feed roller 25 is rotatably supported on one end of the arm 26. The arm 26 is swingably urged toward the paper feed tray 20 by its own weight or urging force of a spring. A feeding motor 85 (hereinafter, referred to as an "LF motor", see FIG. 5) is connected directly or indirectly to the shaft 28. A driving force of the LF motor 85 is transmitted to the sheet feed roller 25 through a driving force transmission mechanism (not shown) provided on the shaft 28 and the arm 26. As the driving force is transmitted to the sheet feed roller 25 in a state that the sheet feed roller 25 is in contact with the stack of recording sheets 50, the topmost recording sheet 50 is separated from the stack by the sheet feed roller 25, and is then fed to the sheet feeding path 23.

Along the sheet feeding path 23, a platen 42 is positioned downstream of the bent portion in the feeding direction. The recording unit 24 is provided above the platen 42.

The recording unit 24 includes a carriage 38. The carriage 38 is capable of reciprocating in a direction perpendicular to the plane of FIG. 2. That is, the direction 55 (hereinafter referred to as a "scanning direction", see FIG. 3) is substantially orthogonal to a feeding direction 17 where each recording sheet 50 is fed on the platen 42. The carriage 38 is reciprocated at predetermined intervals by a known drive mechanism having a belt. The carriage 38 includes an ink-jet recording head 39 (hereinafter, abbreviated as a "recording head"), a photosensor 47 and a head control circuit 33. This means that the recording head 39, the photosensor 47, and the head control circuit 33 reciprocate together with the carriage 38.

Figure 3:
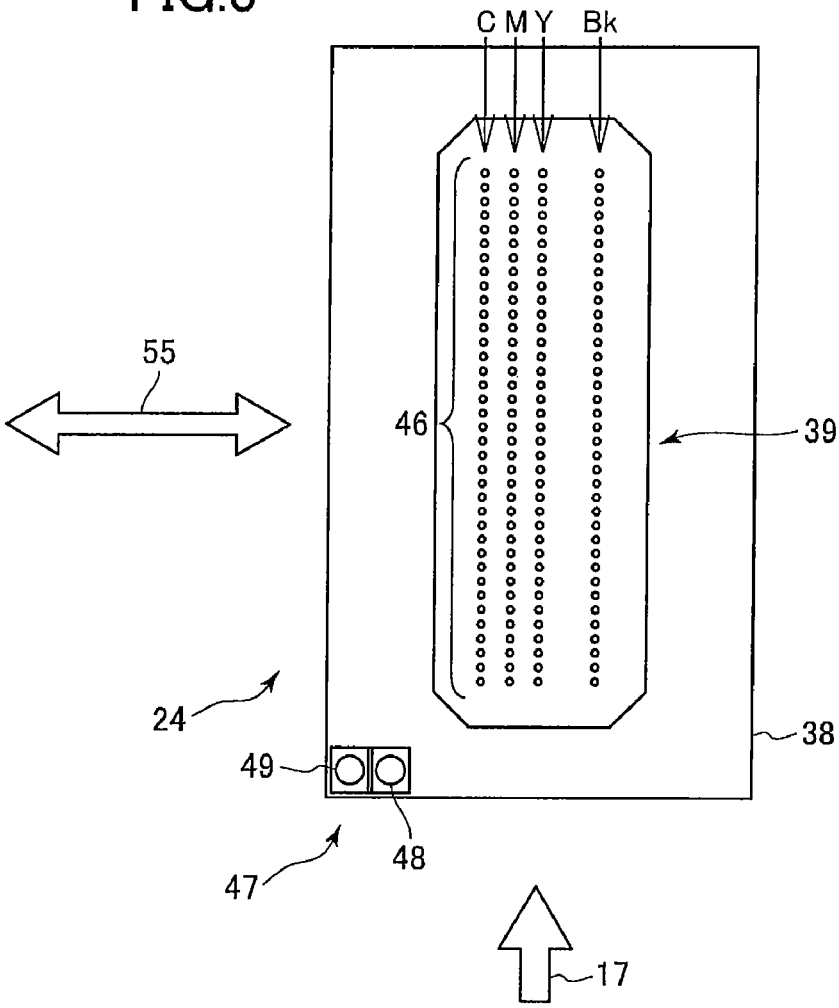
FIG. 3 is a bottom view of the recording unit according to the embodiment.

FIG. 3 is a bottom view of the recording unit 24. As shown in FIG. 3, the recording head 39 includes a plurality of nozzles 46 on the bottom thereof. The head control circuit 33 (see FIG. 2) controls the recording head 39 so that the plurality of nozzles 46 eject ink droplets toward the platen 42 by what is called an ink-jet method. The plurality of nozzles 46 are arranged in the feeding direction 17 of the recording sheet 50, for each of the ink colors cyan (C), magenta (M), yellow (Y), and black (Bk).

Inks of the colors C, M, Y, and Bk are supplied to the recording head 39 from ink cartridges (not shown) through ink tubes. The supplied inks of the colors are distributed to the plurality of nozzles 46 through flow paths formed in the recording head 39. While the carriage 38 is reciprocating in the scanning direction 55, the plurality of nozzles 46 of the recording head 39 eject ink droplets selectively. A recording area 45 positioned immediately below the nozzles 46, or equivalently the recording area 45 indicated by broken lines in FIG. 2 corresponds to the recordable area. The ink droplets ejected from the plurality of nozzles 46 adhere a predetermined portion of the recording sheet 50 within the recording area 45, but do not adhere to any portion outside the recording area 45. Therefore, when the nozzles 46 eject ink droplets selectively in a state that the recording sheet 50 has entered the recording area 45, an image is recorded based on print data, only on the recording surface of the recording sheet 50 corresponding to the recording area 45. In this embodiment, this image recording operation is controlled by the control unit 100 (see FIG. 5).

As shown in FIGS. 2 and 3, the photosensor 47 is positioned upstream of the nozzles 46 in the feeding direction 17 (hereinafter, referred to simply as "upstream"). The photosensor 47 is provided mainly for detecting the positions of both side edges of recording sheet 50. The photosensor 47 is provided in an upstream end portion of the carriage 38, and in a portion corresponding to one end portion of the carriage 38 in the scanning direction 55 (left end in FIG. 3).

Figure 4:
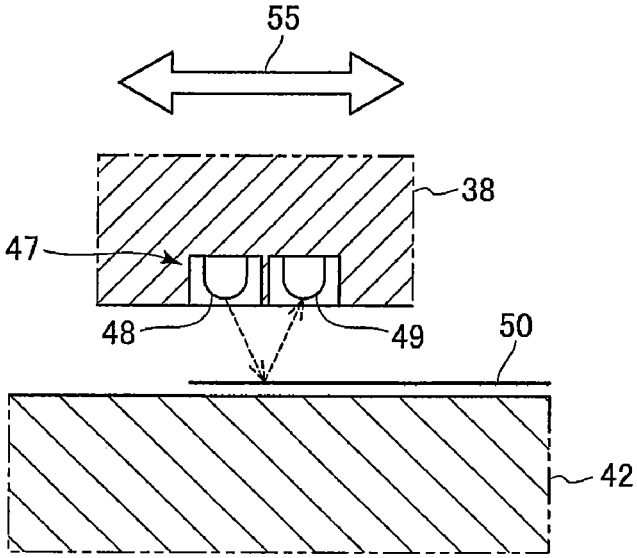
FIG. 4 is a an enlarged cross-sectional view schematically showing a structure of a photosensor of the print unit according to the embodiment.

FIG. 4 is an enlarged cross-sectional view of a structure of the photosensor 47. As shown in FIG. 4, the photosensor 47 is a photoreflector (reflection-type photosensor) which includes a light emitting portion 48 having light-emitting diodes; and a light receiving portion 49. The light emitting portion 48 emits light generally vertically downward. The light receiving portion 49 receives light reflected from the platen 42 or from the recording sheet 50. As the light receiving portion 49 receives the reflected light, the light receiving portion 49 generates detection signals (electric signals such as voltage signals or current signals) according to an intensity of the received light. The light receiving portion 49 is connected to a noise filter 72 to be described later (see FIG. 5). The generated detection signals are outputted to the control unit 100 (see FIG. 5) through the noise filter 72. The color of the top surface of the platen 42 is a dark one having a reflectivity lower than that of the color of the recording sheet 50. Therefore, it the recording surface of the recording sheet 50 is positioned substantially below the photosensor 47, the light receiving portion 49 receives the reflected light, reflected from the recording sheet 50, having a high intensity, and generates detection signals according to the reflected light having the high intensity. On the other hand, if the recording surface of the recording sheet 50 is not placed immediately below the photosensor 47, the light receiving portion 49 receives the reflected light, reflected from the platen 42, having a low intensity, and generates detection signals according to the reflected light having the low intensity.

As shown in FIG. 2, a pair of feeding rollers 59 including a drive roller 60 and a pinch roller 61 is provided upstream of the recording unit 24 in the feeding direction 17. The pinch roller 61 faces the drive roller 60 via the sheet feeding path 23. The pinch roller 61 is urged toward the drive roller 60 with a pressure so that the pinch roller 61 and the drive roller 60 are in contact with each other. As the recording sheet 50 fed from the paper feed tray 20 to the sheet feeding path 23 has entered, the nip area of the pair of feeding rollers 59, the pair of feeding rollers 59 rotates while pinching the recording sheet 50 therebetween so as to feed the recording sheet 50 toward the platen 42 downstream of the pair of feeding rollers 59 in the feeding direction 17.

As shown in FIG. 2, the drive roller 60 includes an encoder disk 19 and a photosensor 73. The encoder disk 19 is a transparent disk which rotates with the drive roller 60. The encoder disk 19 has a plurality of marks arranged radially at a predetermined pitch. The encoder disk 19 is fixed to the shaft of the drive roller 60 so that the encoder disk 19 rotates together with the drive roller 60. The photosensor 73 is provided near the drive roller 60. The photosensor 73 is disposed so that the periphery of the encoder disk 19 is positioned in a space between a light emitting element and a light receiving element.

As the leading edge of the recording sheet 50 has reached the nip, area of the pair of feeding rollers 59, the pair of feeding rollers 59 pinches the recording sheet 50 to feed the recording sheet 50 in the feeding direction 17 intermittently at a predetermined unit feeding amount. Specifically, the drive roller 60 is connected to the LF motor 85 (see FIG. 5). The control unit 100 controls the LF motor 85 to intermittently rotate the drive roller 60 at the rotation amount corresponding to the predetermined unit feeding amount. In this case, the term "unit feeding amount" corresponds to a linefeed width in the feeding direction 17, to be employed when the recording head 39 continuously records an image on the recording sheet 50. While the recording sheet 50 is fed intermittently at the predetermined unit feeding amount, the carriage 38 is scanned in the scanning direction 55 (the direction perpendicular to the plane of FIG. 2) by the control unit 100 and the recording head 39 ejects ink droplets. This recording process is repeated so that image recording is performed on the recording sheet 50 at the predetermined unit feeding amount. As a result, an image with no gaps is recorded on the recording sheet 50.

Downstream of the recording unit 24 in the feeding direction 17 (hereinafter, referred to simply as "downstream"), a pair of discharge rollers 64 including a drive roller 62 and a spur roller 63 is provided. The drive roller 62 is connected to the LF motor 85 (see FIG. 5). The drive roller 62 intermittently rotates in synchronization with the drive roller 60 of the pair of feeding roller 59 by the same driving method. The spur roller 63 faces the drive roller 62 via the sheet feeding path 23. The spur roller 63 is urged toward the drive roller 62 with a pressure so that with each other. The spur roller 63 contacts the recording surface of the recording sheet 50 with a pressure when the recording sheet is interposed between the drive roller 62 and the spur roller 63. The spur roller 63 has a spur-like irregular surface in order not to degrade the image recorded on the recording sheet 50. The pair of discharge roller 64 rotates and pinches the recording sheet 50 which has passed through the platen 42, so as to feed the recording sheet 50 from the sheet feeding path 23 to the paper ejection tray 21.

A registration sensor 71 is provided along the sheet feeding path 23 on the upstream of the drive roller 60. The registration sensor 71 detects existence or nonexistence of the recording sheet 50 fed along the sheet feeding path 23. In this embodiment, a so-called mechanical sensor is employed as the registration sensor 71. Specifically, the registration sensor 71 includes a photointerrupter and a feeler (sensor) pivotally supported in a rotatable manner. The photointerrupter includes a light emitting member for emitting light toward the feeler; and a light receiving member for receiving the light reflected from the feeler. The registration sensor 71 outputs sensor signals based on an intensity of the light received by the light receiving member of the photointerrupter (for example, electric signals according to the intensity of the received light). As the recording sheet 50 has reached a position P1 shown in FIG. 2, the recording sheet 50 makes contact with the feeler, thereby pivoting the feeler. This changes the sensor signals outputted from the registration sensor 71 (specifically, the light receiving member of the photointerrupter). Based on the changes made in the sensor signals outputted from the registration sensor 71, the control unit 100 (see FIG. 5) detects not only the existence or the nonexistence of the recording sheet 50, but also detects whether or not a leading edge of the recording sheet 50 has reached the position P1, or whether or not a trailing edge of the recording sheet 50 has passed through the position P1.

Next, the control unit 100 included in the multifunction peripheral 10 will be described with reference to FIG. 5. FIG. 5 is a block diagram showing a structure of the control unit 100.

The control unit 100 controls various electrical drive units included in the multifunction peripheral 10, so as to control the operation of the multifunction peripheral 10 as a whole. As shown in FIG. 5, the control unit 100 is a microcomputer including a CPU 101, a ROM 102, a RAM 103, and an EEPROM 104. The control unit 100 is connected to the operation panel, 40 and an application specific integrated circuit (ASIC) 109 through a bus 107. Since the control structure of the scanner unit 12 is not a primary concern in the present invention, its detailed description is omitted in this embodiment.

The ROM 102 stores programs so that the CPU 101 controls various operations of the multifunction peripheral 10.

The RAM 103 is used as a storage area for temporarily storing various kinds of data to be used when the CPU 101 executes each of the programs, or used as a work area. For example, the RAM 103 stores print data to be used for image recording, and various kinds of status information to be displayed on the LCD 41.

The EEPROM 104 stores settings, flags and the like to be maintained even after powering off the multifunction peripheral 10. The EEPROM 104 further stores a threshold value table 36 shown in FIG. 12. The threshold value table 36 is described later.

The status information stored in the RAM 103 or the like is read from the RAM 103 at a predetermined timing in response to an instruction of the CPU 101. The read status information is then transferred to the LCD 41 of the operation panel 40. The status information transferred to the LCD 41 is outputted to the screen of the LCD 41 by an LCD driver of the LCD 41. Thus, the user can check the status information on the screen of the LCD 41.

The ASIC 109 is connected to a head control circuit 33, a drive circuit 82, a drive circuit 81, a noise filter 72, a rotary encoder 83, a linear encoder 84, and a registration sensor 71.

The head control circuit 33 drives and controls the recording head 39 based on CMYBk print data inputted from the ASIC 109. The plurality of nozzles 46 of the recording head 39 (see FIG. 3) then eject ink of each color selectively at a predetermined moment so as to record an image on the recording sheet 50.

The drive circuit 82 applies drive signals to a carriage motor (hereinafter, referred to as a "CR motor") 80 based on phase excitation signals or the like inputted from the ASIC 109. A reciprocation motion of the carriage 38 is controlled by rotation of the CR motor 80 which receives the drive signals.

The drive circuit 81 drives the LF motor 85. The LF motor 85 is connected to the sheet feed roller 25, the drive roller 60, and the drive roller 62 shown in FIG. 2, through a known driving force transmission mechanism including a gear and a shaft. The drive circuit 81 drives the LF motor 85 in, response to signals outputted from the ASIC 109. The driving force of the LF motor 85 is selectively transmitted to the sheet feed roller 25, the drive roller 60, and the drive roller 62, through the driving force transmission mechanism.

The rotary encoder 83 measures the rotation of the drive roller 60 to detect the feeding amount of the recording sheet 50. The rotary encoder 83 counts the number of marks of the encoder disk 19 based on a detecting result of the photosensor 73, so as to detect the rotation of the encoder disk 19. Since the drive roller 60 rotates with the encoder disk 19, the rotation of the drive roller 60, or equivalently the feeding amount of the recording sheet 50 can be detected by detecting the rotation of the encoder disk 19. The control unit 100 controls the LF motor 85 according to a detecting result of the rotary encoder 83.

The linear encoder 94 detects the movement distance of the carriage 38 which reciprocates in the scanning direction 55. Since the photosensor 47 is mounted on the carriage 38, the linear encoder 84 can detect the position of the photosensor 47 relative to the recording sheet 50 in the scanning direction 55. Although not shown, encoder strips are provided in the scanning direction 55 of the carriage 38. The linear encoder 84 detects the encoder strips by a photointerrupter mounted on the carriage 38. The control unit 100 detects the position of the photosensor 47 mounted on the carriage 38 and controls the rotation of the CR motor 80 based on a detecting result of the linear encoder 84.

The photosensor 47 is connected to the noise filter 72. The noise filter 72 removes noise contained in the detection signals (electric signals) from the photosensor 47, and then outputs the detection signals to the control unit 100. Based on the detection signals outputted from the noise filter 72, the control unit 100 detects whether or not the leading edge of the recording sheet 50 fed along the sheet feeding path 23 has reached a predetermined position, or detects positions of both side edges of the recording sheet 50 in the scanning direction 55. Specifically, the leading edge of the recording sheet 50 which has reached the predetermined position is detected by the fact that the detection signals exceed a predetermined threshold value. The positions of both side edges of the recording sheet 50 are detected by the fact that the detection signals fall below the predetermined threshold value.

The multifunction peripheral 10 according to this embodiment thus structured, can determine the status of the recording sheet 50 which is being fed along the sheet feeding path 23 before the printing unit 11 performs image recording operation. Specifically, the multifunction peripheral 10 can detect a skew (positional deviation) of the recording sheet 50 with respect to the sheet feeding direction 17. This determination process (hereinafter, referred to as a paper skew determination process") is performed mainly by the control unit 100.

Figure 6:
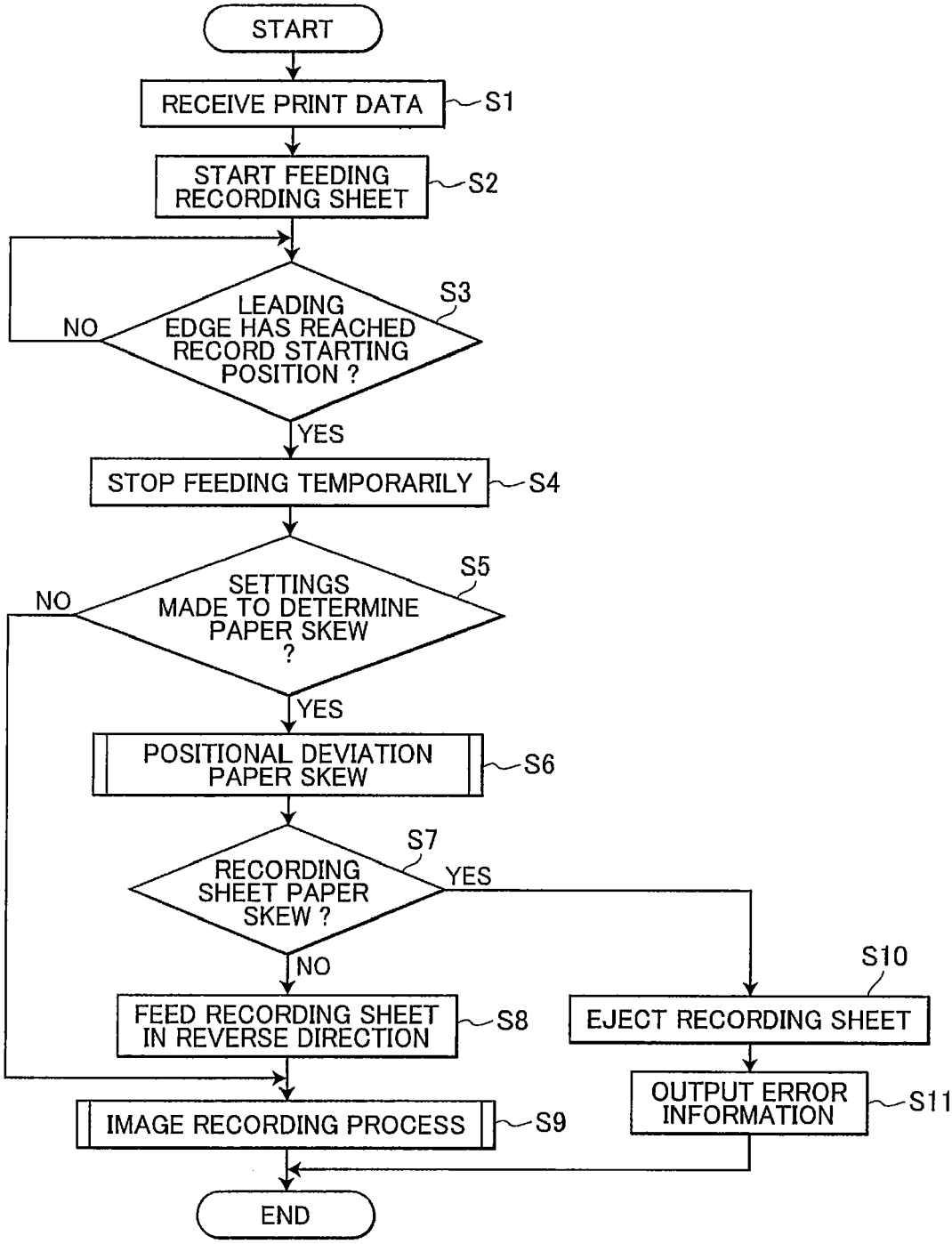
FIG. 6 is a flowchart illustrating steps in an image recording process performed on the multifunction peripheral.
Figure 7:
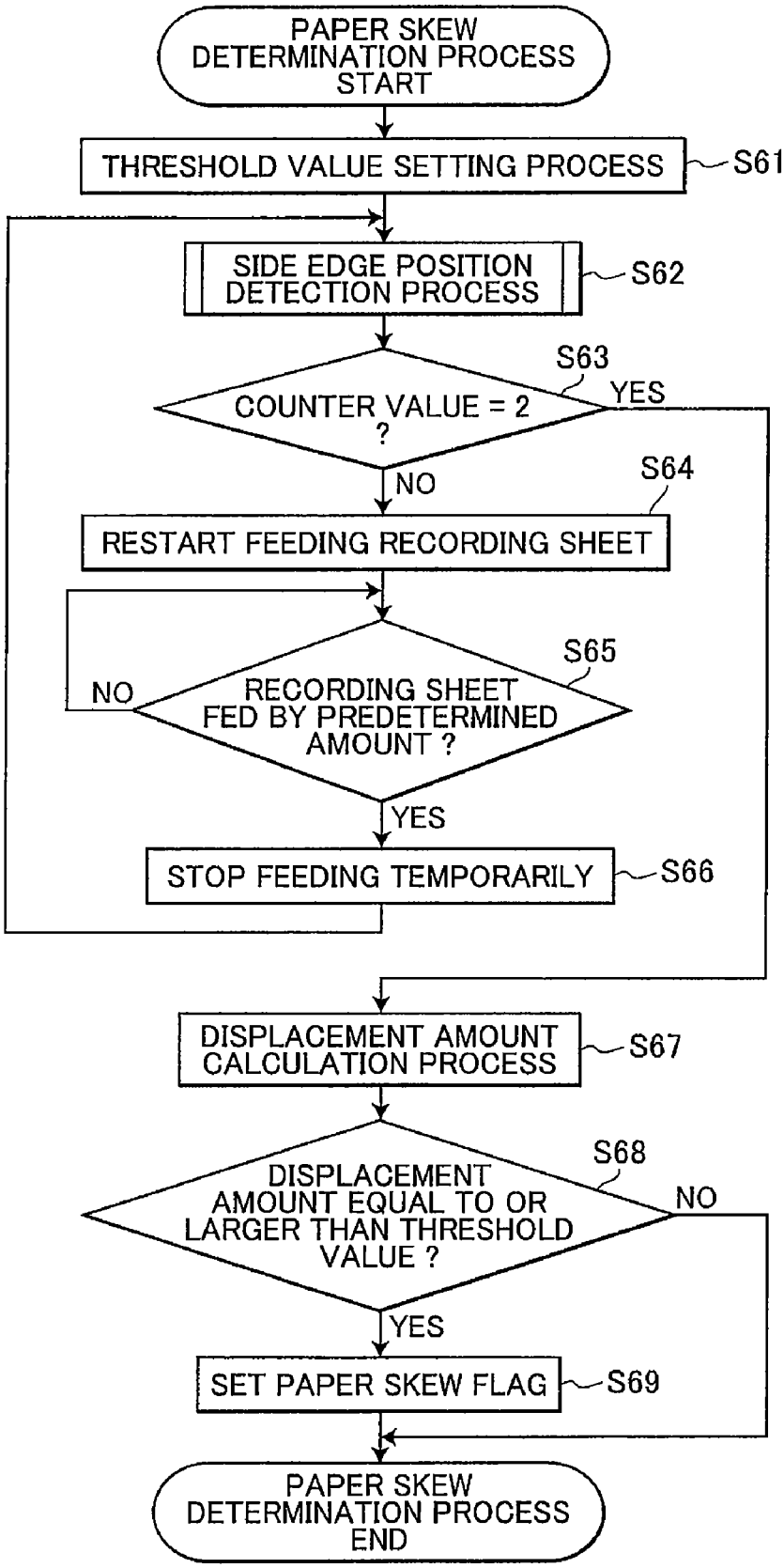
FIG. 7 is a flowchart illustrating steps in a paper skew determination process performed on the multifunction peripheral.
Figure 8:
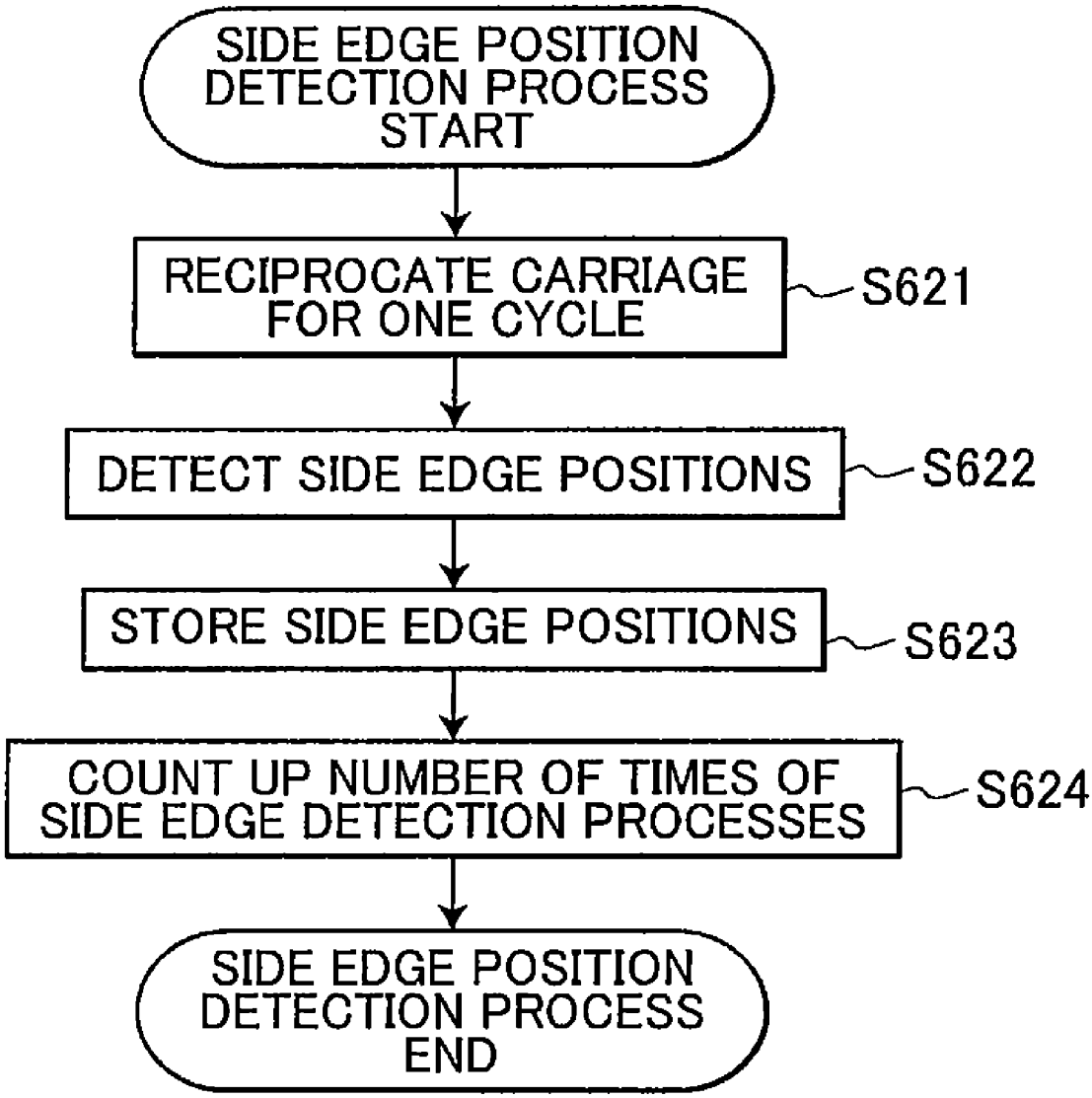
FIG. 8 is a flowchart illustrating steps in a side edge detection process performed on the multifunction peripheral.
Figure 9:
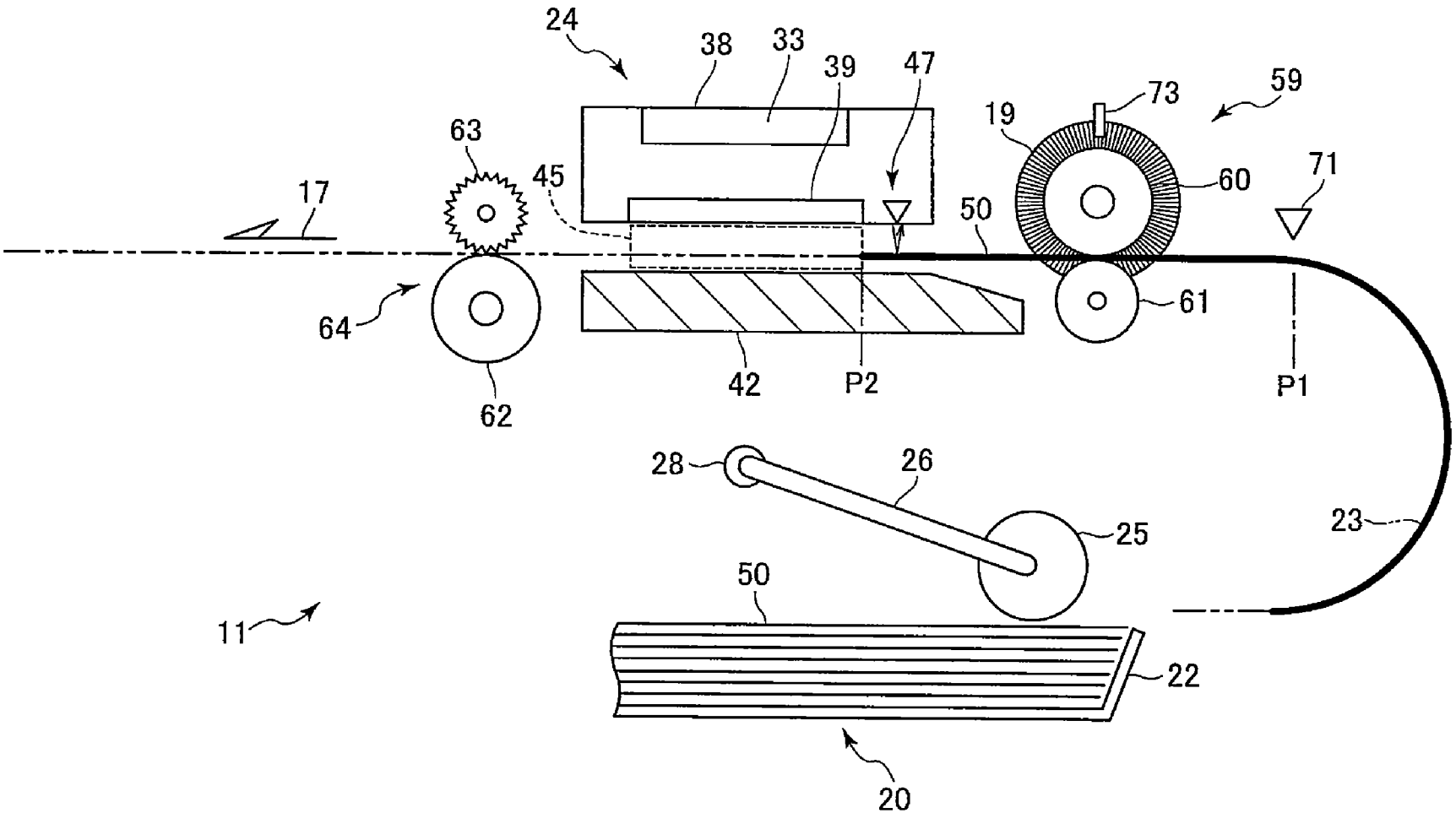
FIG. 9 is a schematic diagram showing the inner structure of the printing unit when a leading edge of a recording sheet reaches a record starting position P.
Figure 10:
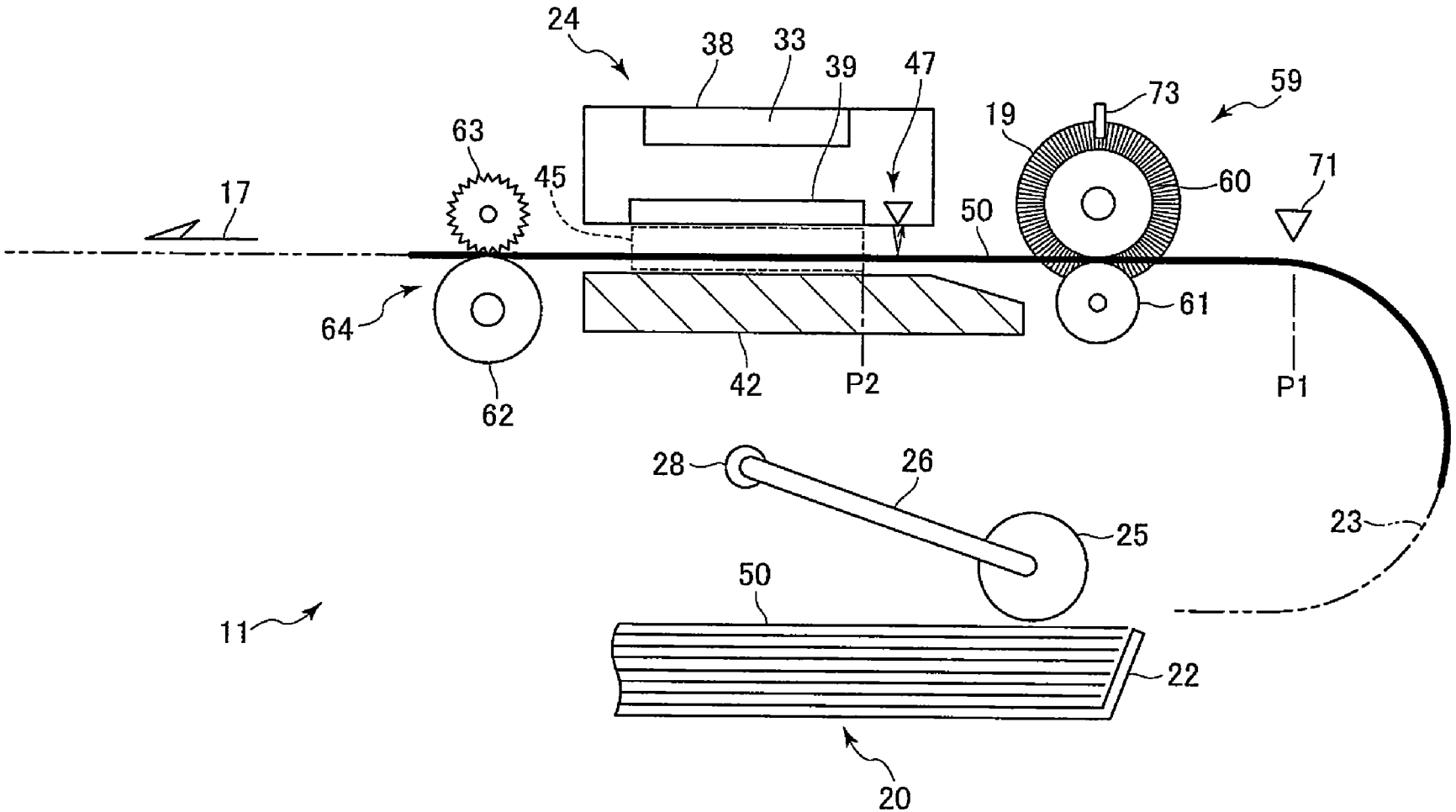
FIG. 10 is a schematic diagram showing the inner structure of the printing unit when the recording sheet is fed by predetermined amount.
Figure 11:
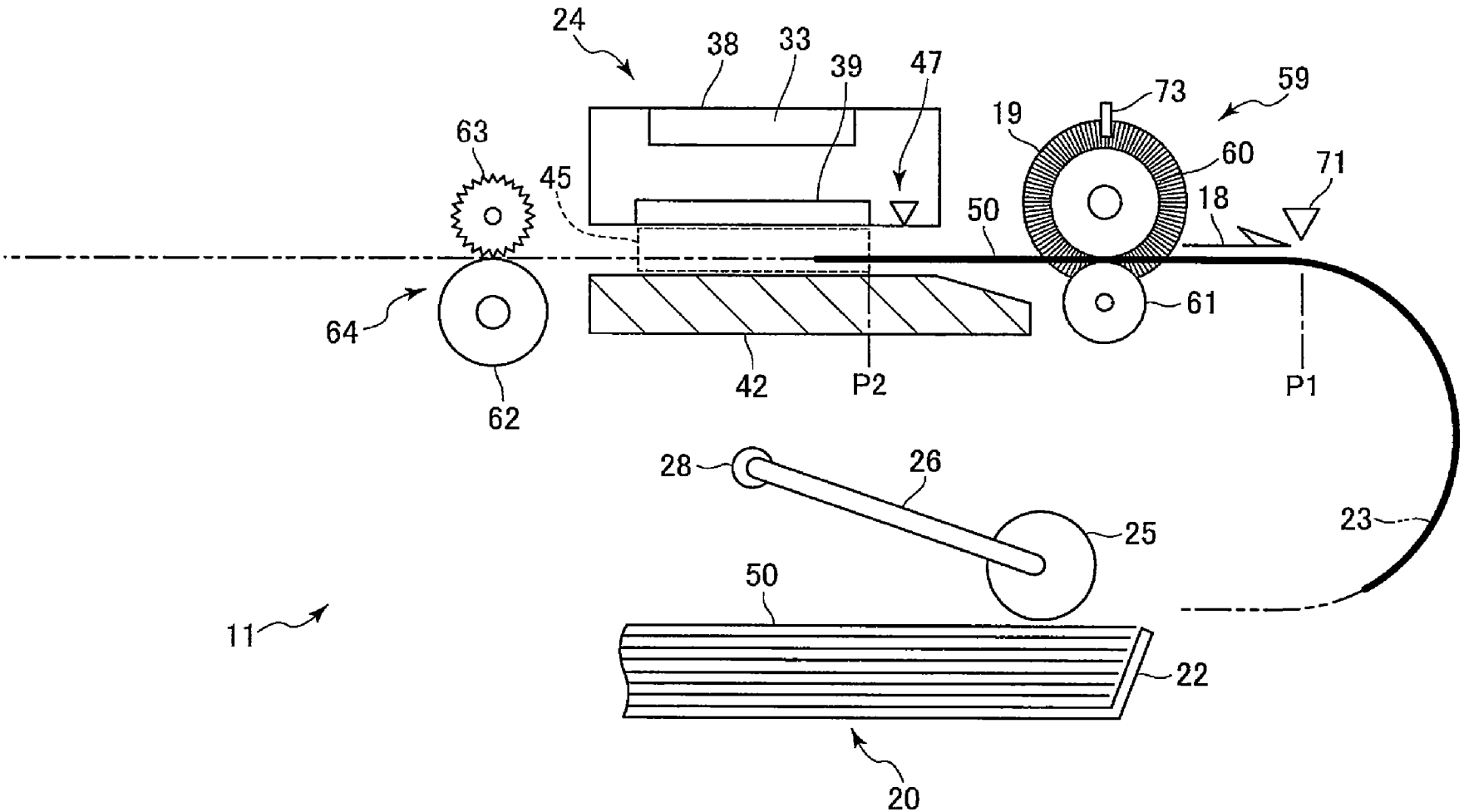
FIG. 11 is a schematic diagram showing the inner structure of the printing unit when the recording sheet is fed in a reverse feeding direction.

Hereinafter, an exemplary procedure of the paper skew determination process and an exemplary procedure of a post-process to be performed after the paper skew determination process as required are described with reference to FIGS. 6 through 11. FIG. 6 is a flowchart illustrating steps in an image recording process starting from a print instruction to image recording. FIG. 7 is a flowchart illustrating steps in the paper skew determination process. FIG. 8 is a flowchart illustrating steps in a side edge detection process. This processes starts from S1 of FIG. 6. FIG. 9 through FIG. 11 are schematic diagrams showing the inner structure of the printing unit 11. The each process described with reference to FIGS. 6 through 8 are performed according to the instructions issued by the control unit 100 based on the control programs stored in the ROM 102.

In S1, as the external device transfers print data to the multifunction peripheral 10 with a print command, the control unit 100 receives the print data. In S2 the control unit 100 drives the sheet feed roller 25 to start feeding one of recording sheets 50 accommodated on the sheet cassette 15 to sheet feeding path 23.

In S3 the control unit 100 determines whether or not the leading edge of the recording sheet 50 in the feeding direction 17 has reached a record starting position P2 where the recording head 39 starts image recording. In this case, the record starting position P2 is a position corresponding to an upstream end of the recording area 45 as shown in FIG. 9. The control unit 100 makes the determination of S3 based on that the rotation amount of the drive roller 60 has reached a predetermined value after the registration sensor 71 detects the leading edge of the recording sheet 50. The predetermined value corresponds to a feed path length between the registration sensor 71 and the record starting position P2. For example, the number of rotations of the drive roller 60 or the number of control steps of the LF motor 85 is employed as the predetermined value.

The control unit 100 may determine whether or not the leading edge of the recording sheet 50 has reached the record starting position P2, for example, depending on whether or not the distance fed by the recording sheet 50 after the photosensor 47 detects the leading edge of the recording sheet 50 is equivalent to the distance between the photosensor 47 and the record starting position P2. Since the feeding distance after the photosensor 47 detects the leading edge is relatively short, the control unit 100 can coincide the leading edge of the recording sheet 50 with the record starting position P2 more accurately.

In S4, as the leading edge of the recording sheet 50 in the feeding direction 17 has reached the record starting position P2, the control unit 100 temporarily stops feeding the recording sheet 50.

In a conventional image recording process, as the leading edge of the recording sheet 50 has reached the record starting position P2, the control unit 100 performs image recording on the recording sheet 50. In this embodiment, in S5 the control unit 100 determines whether or not setting information to command the execution of the paper skew determination process is included in header information of the print data or the like, before image recording. For example, if the user has made print settings so that the paper skew determination process is performed by a printer driver or the like as the user issues a print command to the multifunction peripheral 10, the setting information is transferred to the multifunction peripheral 10 with the print data and the header information. In S5 the control unit 100 determines whether or not the paper skew determination process is performed, based on the setting information thus transferred.

If the control unit 100 has determined that the setting information to command the execution of the paper skew determination process is included in the header information (S5: YES), in S6 the control unit 100 performs the paper skew determination process. On the other hand, if the control unit 100 has determined that the setting information to command the execution of the paper skew determination process, is not included in the header information (S5: NO), in S9 the control unit 100 performs image recording on the recording sheet 50 without performing the paper skew determination process. The image-recorded recording sheet 50 is then ejected to the paper ejection tray 21.

As shown in FIG. 7, the paper skew determination process of S6 starts from a threshold value setting process of S61. The threshold value setting process is a process for setting an appropriate threshold value to be used in a displacement amount determination process in S68 to be described later. In this case, the threshold value means the allowable upper limit of the displacement amount calculated in a displacement amount calculation process of S67 to be described later. The threshold value used in S61 are prestored in the RAM 103 in the form of the threshold value table 36 shown in FIG. 12.

As shown in FIG. 12, in this embodiment, the threshold value table 36 includes sheet sizes supported by the multifunction peripheral 10 for image recording; and the appropriate threshold value corresponding to each sheet size. Although the threshold values included in the threshold value table 36 correspond only to recording sheet size in this embodiment, the threshold values may be determined based on type of the recording sheet 50 including at least one of the sheet size, the sheet thickness, and the sheet material.

As shown in FIG. 12, the threshold value table 36 includes the threshold values corresponding to the following types of the recording sheet 50: L size, A6 size, 2L size, postcard size, A5 size, A4 size, and legal size, in order of size from the one having the shortest length in the feeding direction 17. Although these threshold values can be decided arbitrarily, the threshold values are calculated by the following Equation (1) in this embodiment. In Equation (1), "α" is the threshold value for L size, "β" is the threshold value for each size except L size, "X" is the length of L size, "Y" is the length of each size except L size, and "k" is the proportional constant unique to the multifunction peripheral 10. In this embodiment, the threshold values corresponding to each size except L size is calculated by assigning the value 1 to the proportional constant k.

$$\beta = a \times k(X/Y) \qquad \text{Equation (1)}$$

Figure 13B:
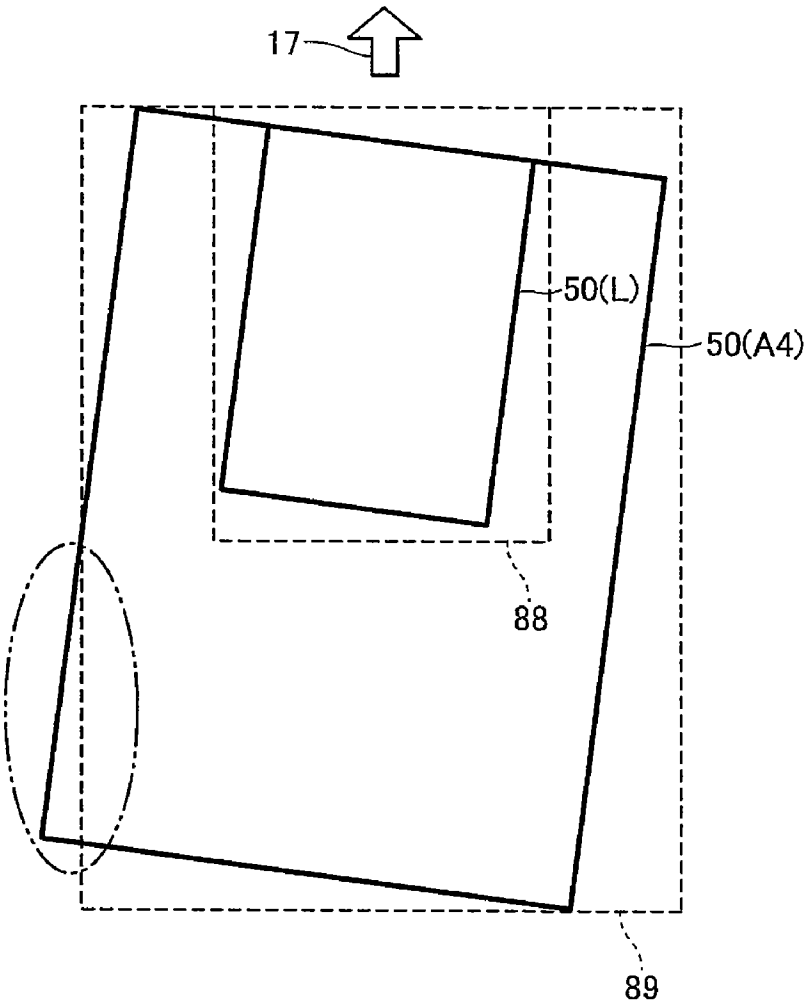
FIGS. 13A and 13B are explanatory diagrams showing a difference in displacement amounts depending on the types of the recording sheet.
Figure 13A:
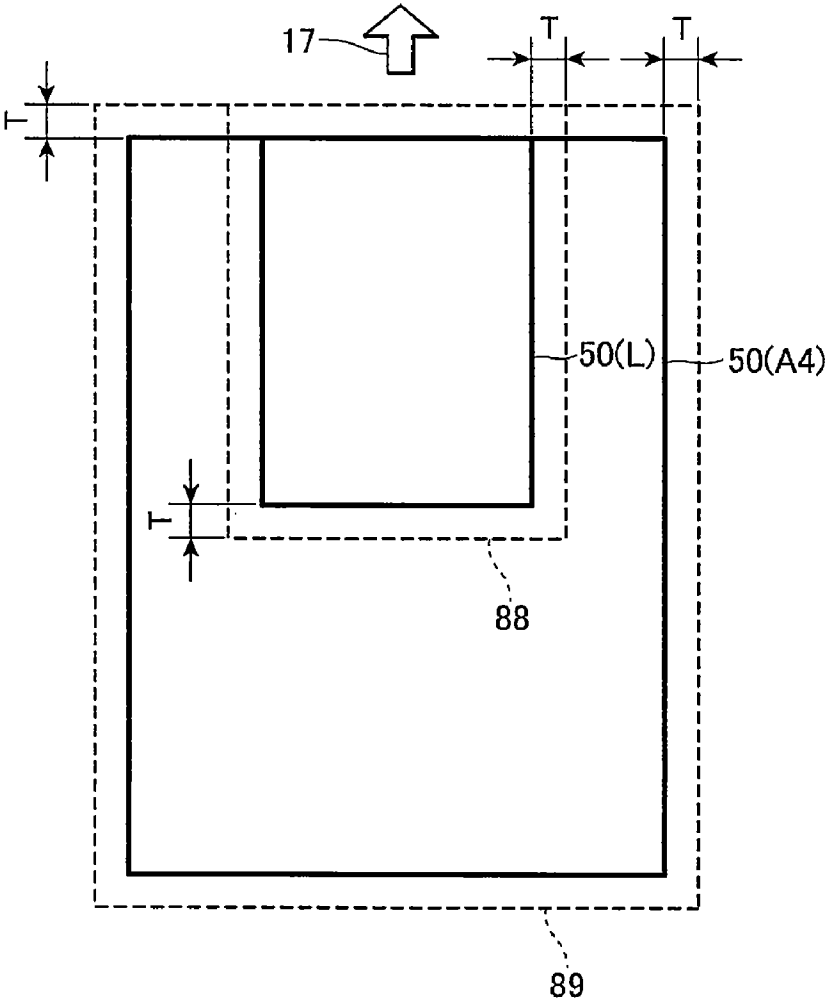

According to Equation (1), the threshold value of each size except L size is inversely proportional to its length in the feeding direction 17. Specifically, as a given sheet size has a longer length in the feeding direction 17, the threshold value thereof becomes smaller. This is because of the difference in displacement amounts depending on the types of the recording sheet 50. For example, if an L-sized recording sheet and an A4-sized recording sheet larger than the L-sized recording sheet incline at the same angle, their displacement amounts between the leading edge and the trailing edge are different. When a so-called borderless printing (a printing without a margin) is performed, each of image data 88 and 89 having a size slightly larger than that of each recording sheet is used for image recording as shown in FIG. 13A. In this case, the image data 88 corresponds to an L-sized recording sheet 50(L), whereas the image data 89 corresponds to an A4-sized recording sheet 50(A4). The margin widths T (see FIG. 13A) of the image data 88 and 89 relative to the corresponding recording sheets 50 are fixed regardless of recording sheet size. If the same threshold value is applied to both of the recording sheets 50(L) and 50(A4) and an intended image is recorded on the surface of; the recording sheet 50(L), a displacement equal to or larger than the margin width T occurs on the recording sheet 50(A4) as shown in FIG. 13B. As a result, the whole intended image is not included on the recording surface. A portion of the recording sheet 50(A4) (indicated by a two-dot chain line in FIG. 13B) cannot cover the image data 89, thereby causing, the intended image to lose a portion thereof. In order to avoid such a situation, in this embodiment, appropriate threshold values are determined by Equation (1).

As the threshold value corresponding to L size, an arbitrary value has to be obtained before image recording by empirical rules, experiments and the like.

As shown in FIG. 7, in S61 the control unit 100 extracts the threshold value corresponding to the size obtained from the header information of the print data, from the threshold value table 36. The control unit 100 then stores the extracted threshold value in the RAM 103 or the like, as a determination value to be employed in a displacement amount calculation process of S67 to be described later.

Upon setting the threshold value in S61, in 562 the control unit 100 performs a side edge position detection process for the first time. Specifically, as shown in FIG. 8, in S621 the control unit 100 reciprocates the carriage 38 for one cycle over the recording sheet 50 at rest, which the leading edge thereof has reached the record starting position P2. In S622, while the carriage 38 is reciprocating, the control unit 100 detects the positions of both side edges of the recording sheet 50 based on the detection signals from the photosensor 47. Specifically, when the detection signals received from the photosensor 47 through the noise filter 72 becomes lower than the predetermined threshold value, the control unit 100 determines a position of the photosensor 47 as an edge position of the recording sheet 50. The position of the photosensor 47 can be detected by the linear encoder 84. Thus, the position of each side edge near the leading edge of the recording sheet 50 is detected. In S623 the both side edge positions thus detected are stored temporarily in the RAM 103. In S624 a counter (not shown) for counting the number of times of the side edge position detection process is counted up (incremented).

After the control unit 100 has finished the first side edge position detection process in S62, the control unit 100 refers to the value of the counter to determine whether or not the side edge position detection process has been performed twice in S63. If the control unit 100 determines that the side edge position detection process has been performed less than twice, in S64 the control unit 100 restarts feeding the recording sheet 50.

In S64, although a portion of the recording sheet 50 on the side of the leading edge enters the recording area 45, the recording head 39 does not perform image recording. In S65 the control unit 100 determines whether or not the recording sheet 50 has been fed by a predetermined amount (predetermined distance) after restarting feeding the recording sheet 50. The predetermined amount may be a fixed amount to be applied uniformly to the recording sheets of any size, regardless of type of recording sheet 50. Alternatively, the predetermined amount may be a unique amount which has been preset for each type of recording sheet 50. In this case, the amount obtained by multiplying the length of the recording sheet 50 in the feeding direction 17 by a fixed percent is preferably employed as the predetermined amount. The predetermined amount for each type of recording sheet 50 is calculated based on the size of the recording sheet 50 obtained from the header information of the print data, and then stored in a prescribed storage area such as the RAM 103.

As shown in FIG. 10, when the control unit 100 has fed the recording sheet 50 by the predetermined amount (S65: YES), in 566 the control unit 100 temporarily stops feeding the recording sheet 50 again. The leading edge of the recording sheet, 50 passes the recordable area 45 shown in FIG. 10. After that, in S62 the control unit 100 performs another side edge a position detection process (see FIG. 8) for the second time. In this embodiment, the side edge detection process is performed twice so that both side edge positions are detected, at separated two portions in the feeding direction 17 on the recording sheet 50.

As the control unit 100 has finished the second side edge detection process in S62, the control unit 100 refers again to the value of the counter to determine whether or not the side edge position detection process has been performed twice in S63. If the control unit 100 determines that the side edge position detection process has been performed twice (S63: YES), in S67 the control unit 100 performs the displacement amount calculation process for calculating a displacement amount. Specifically, the control unit 100 calculates two positional displacement amounts based on the side edge positions of the two portions detected in the side edge position detection processes. The value of the counter is reset after the control unit 100 determines that the side edge position detection process has been performed twice (S63: YES).

In S68 the control unit 100 compares each of the two displacement amounts calculated in S67 with the threshold value set in S61 to determine whether or not the displacement amount is equal to or larger than the threshold value. If at least one of the two displacement amounts is equal to or larger than the threshold value (S68: YES), the control unit 100 determines that the recording sheet 50 has an unacceptable paper skew (unacceptable displacement amount) with respect to the sheet feeding direction 17. In this case, in S69 the control unit 100 sets a paper skew flag indicating that the recording sheet 50 has the unacceptable displacement amount, in the RAM 103, a register of the CPU 101, or the like. If each of the two displacement amounts is smaller than the threshold value (S68: NO), the control unit 100 determines that the recording sheet 50 has an acceptable paper skew (acceptable displacement amount) or no paper skew. In this case, the control unit 100 finishes the paper skew determination process without setting the paper skew flag.

After the control unit 100 has finished the paper skew determination process of S6 shown in FIG. 6, in S7 the control unit 100 then determines whether or not the recording sheet 50 has a paper skew based on whether the paper skew flag has been set in S69. If the control unit 100 has determined that the recording sheet 50 has the paper skew (S7: YES), in S10 the control unit 100 discharges the recording sheet 50 to the paper discharge tray 21 without performing image recording. In S11 error, information indicating that the recording sheet 50 has the paper skew is displayed on the LCD 41.

On the other hand, if the control unit 100 has determined that the recording sheet 50 does not have the paper skew (S7: NO), in S8 the control unit 100 feeds the recording sheet 50 in a reverse feeding direction 18 opposite to the feeding direction 17 (see FIG. 11). Specifically, when the so-called borderless printing is performed on the recording sheet 50, since image recording is started from the leading edge of the recording sheet 50, the control unit 100 feeds the recording sheet 50 in the reverse direction until the leading edge of the recording sheet 50 reaches the record starting position P2. On the other hand, a printing with a margin is performed on the recording sheet 50, the control unit 100 feeds the recording sheet 50 in the reverse feeding direction 18 until a leading edge of the area in which image recording is performed, or a equivalently a boundary between the image recording area and the margin at the leading edge of the recording sheet 50 reaches the record starting position P2. Furthermore, if the control unit 100 records an image small enough for the recording sheet 50, the control unit 100 feeds the recording sheet 50 in the reverse feeding direction 18 until a leading edge of the image to be recorded reaches the record starting position P2.

After feeding the recording sheet 50 in the reverse feeding direction 18 in S8, the control unit 100 starts image recording from the leading edge of the recording sheet 50 in S9. Specifically, the control unit 100 starts feeding the recording sheet 50 intermittently in the feeding direction 17. During the intermittent feeding, the nozzles 46 of the recording head 39 eject ink droplets toward the recording sheet 50. The image-recorded recording sheet 50 is then discharged on the paper discharge tray 21.

According to the multifunction peripheral 10 of this embodiment, the control unit 100 determines whether or not the recording sheet 50 has the paper skew, in a state that the leading edge of the recording sheet 50 has entered the recording area 45, or equivalently in a state that the recording sheet 50 has reached the position where image recording is to be performed, without performing image recording. Since the control unit 100 determines whether or not the recording sheet 50 has the paper skew, in an area where image recording is to be performed, the control unit 100 can determine the feeding status of the recording sheet to immediately before image recording.

Furthermore, the control unit 100 determines whether or not the recording sheet 50 has the paper skew before image recording is performed on the recording sheet 50, thereby avoiding wasteful consumption of sheet members and recording materials including ink, caused by a slant image recorded unintentionally.

While the invention has been described in detail with reference to specific embodiments thereof, it would be apparent to those skilled in the art that many modifications and variations may be made therein without departing from the spirit of the invention, the scope of which is defined by the attached claims. For example, in this embodiment, the multifunction peripheral 10 which includes the printing unit 11 employing an ink-jet recording method is given as an example. However, the present invention is also applicable to a so-called an electrophotographic image recording device employing toner to form an image on a recording sheet.

In this embodiment, if the control unit 100 determines that the recording sheet 50 does not have the paper skew, the control unit 100 feeds the recording sheet 50 in the reverse direction 18. However, if image recording is performed at a position on the recording sheet 50 closer to the trailing edge, rather than the position where the second side edge position detection process is performed, the control unit 100 does not have to feed the recording sheet 50 in the reverse feeding direction 18. In this case, the control unit 100 feeds the recording sheet 50 in the feeding direction 17 instead of the reverse feeding direction 18, the control unit 100 can perform the image recording process of S9 after coinciding a leading edge of the image with the record starting position.

In the above embodiment, in S68 the control unit 100 compares each of the two displacement amounts calculated in S67 with the threshold value set in S61 to determine whether or not the displacement amount is equal to or larger than the threshold value. However, the control unit 100 may only compare one of the two displacement amounts calculated in S67 with the threshold value set in S61.

Further, in S4, as the leading edge of the recording sheet 50 has reached the record starting position P2, the control unit 100 temporarily stops feeding the recording sheet 50. However, as the leading edge or the recording sheet 50 has reached a position upstream of the record stating position P2, the control unit 100 may temporarily stop feeding the recording sheet 50. In this case, in S3 the control unit 100 determines whether or not the leading edge of the recording sheet 50 in the feeding direction 17 has reached the position upstream of the record stating position P2 and in S62 the control unit 100 performs the side edge position detection process for the first time while the leading edge of the recording sheet 50 is located at the position upstream of the record stating position P2. Further, in S65 when the control unit, 100 has fed the recording sheet 50 by the predetermined amount, the leading edge of the recording sheet 50 passes the recordable area 45 shown in FIG. 10. However, when the control unit 100 has fed the recording sheet 50 by the predetermined amount, the leading edge of the recording sheet 50 may not pass the recordable area 45.

What is claimed is:

1. An image recording device comprising:

a sheet feeding unit that feeds a sheet member along a sheet feeding path in a sheet feeding direction;

an image recording unit that records an image on the sheet member and defines a recordable area which is an area for forming the image on the sheet member;

a first feeding control unit that controls the sheet feeding unit to feed the sheet member to an entry position before the image recording unit starts to record the image on the sheet member;

a determination unit that determines whether the sheet member located at the entry position has a skew; and a recording control unit that controls an image forming operation of the image recording unit based on a determination result of the determination unit, wherein the sheet member has a first position and a second position which are separated from each other in the sheet feeding direction;

wherein the determination unit comprises:

a detection unit that detects a first one side edge position of the first position of the sheet member and a second one side edge position of the second position of the sheet member in a widthwise direction perpendicular to the sheet feeding direction; and a calculation unit that calculates a displacement amount based on the first one side edge position and the second one side edge position;

wherein the image recording unit comprises:

a carriage that reciprocates in the widthwise direction and supports the detection unit; and a recording head that is supported by the carriage and ejects ink droplets to the recording sheet for forming the image, the detection unit positioned upstream from the recording head in the sheet feeding direction, wherein the determination unit determines that the sheet member has the skew if the displacement amount is equal to or greater than a predetermined threshold value, wherein the first feeding control unit controls the sheet feeding unit to temporarily stop the sheet member before a leading edge of the sheet member reaches the recordable area, to restart feeding the leading edge to enter into the recordable area, and to temporarily stop the sheet member after the leading edge passes the recordable area; and wherein the detection unit is reciprocated by the carriage to detect the first one side edge position of the first position when the first feeding control unit firstly temporarily stops the sheet member, and moves with the carriage to detect the second one side edge position of the second position when the first feeding control unit secondly temporarily stops the sheet member.

2. The image recording device according to claim 1, wherein the entry position is a position where a portion of the sheet member enters into the recordable area.

3. The image recording device according to claim 1, wherein the recording control unit controls the recording unit to execute recording of the image on the sheet member if the determination unit determines the sheet member is free of the skew, and controls the recording unit to fail recording of the image on the sheet member if the determination unit determines the sheet member has the skew.

4. The image recording device according to claim 1, further comprising a second feeding control unit that controls the sheet feeding unit to discharge the sheet member from the sheet feeding path if the determination unit determines the sheet member has the skew.

5. The image recording device according to claim 1, further comprising a second feeding control unit that controls the sheet feeding unit to feed the sheet member from the entry position to a recording position where the image recording unit starts to form the image on the sheet member, in a direction opposite to the sheet feeding direction if the sheet member is free of the skew, wherein the entry position is positioned upstream from the recording position in the sheet feeding direction.

6. The image recording device according to claim 1, further comprising a storage unit that stores the predetermined threshold value corresponding to a type of the sheet member, wherein the determination unit determines that the sheet member has the skew if the displacement amount is equal to or larger than the predetermined threshold value corresponding to the type of the sheet member.

7. The image recording device according to claim 6, wherein the type of the sheet member includes at least one of size, thickness, and material of the sheet member.

8. The image recording device according to claim 1, wherein the first feeding control unit, the determination unit, and the recording control unit are activated based on a control signal.

9. The image recording device according to claim 1, further comprising a output unit that outputs error information indicating the sheet member having the skew, if the determination unit determines that the sheet member has the skew.

10. The image recording device according to claim 1, wherein the detection unit is supported by the carriage.

11. A determination method for an image recording device comprising a sheet feeding unit that feeds a sheet member along a sheet feeding path in a sheet feeding direction, and an image recording unit that records an image on the sheet member and defines a recordable area which is an area for forming the image on the sheet member, the determination method comprising:

controlling the sheet feeding unit to feed the sheet member to an entry position before the image recording unit starts to record the image on the sheet member;

determining whether the sheet member located at the entry position has a skew before the image recording unit starts to record the image on the sheet member; and controlling the image recording unit to record the image on the sheet member based on a determination result of the determining step;

wherein the sheet member has a first position and a second position which are separated from each other in the sheet feeding direction;

wherein the determining step comprises:

controlling a detection unit to detect a first one side edge position of the first position of the sheet member and a second one side edge position of the second position of the sheet member in a widthwise direction perpendicular to the sheet feeding direction; and calculating a displacement amount based on the first one side edge position and the second one side edge position;

wherein the image recording unit comprises:

a carriage that reciprocates in the widthwise direction and supports the detection unit; and a recording head that is supported by the carriage and ejects ink droplets to the recording sheet for forming the image, the detection unit positioned upstream from the recording head in the sheet feeding direction, wherein the sheet member is determined to have the skew if the displacement amount is equal to or greater than a predetermined threshold value, wherein the sheet feeding unit is controlled to temporarily stop the sheet member before a leading edge of the sheet member reaches the recordable area, to restart feeding the leading edge to enter into the recordable area, and to temporarily stop the sheet member after the leading edge passes the recordable area; and wherein the detection unit is reciprocated by the carriage to detect the first one side edge position of the first position when the first feeding control unit firstly temporarily stops the sheet member, and moves with the carriage to detect the second one side edge position of the second position when the first feeding control unit secondly temporarily stops the sheet member.

12. The determination method according to claim 11, wherein the entry position is a position where a portion of the sheet member enters into the recordable area.

* * * * *